United States Patent [19]

Still

[11] 4,095,655

[45] Jun. 20, 1978

[54] EARTH PENETRATION

[76] Inventor: William L. Still, P.O. Box 878, Purcellville, Va. 22132

[21] Appl. No.: 621,787

[22] Filed: Oct. 14, 1975

[51] Int. Cl.[2] ..... E21B 11/02; E21B 1/06

[52] U.S. Cl. ..... 175/19; 175/94; 175/73; 299/31

[58] Field of Search ..... 175/19, 94, 230, 73, 175/74, 76; 299/14, 31

[56] References Cited

U.S. PATENT DOCUMENTS

| | | | |
|---|---|---|---|
| 2,946,578 | 7/1960 | De Smaele | 175/76 X |
| 3,082,792 | 3/1963 | Jenkins | 92/94 |
| 3,180,437 | 4/1963 | Kellner et al. | 175/94 X |
| 3,330,368 | 7/1967 | Baran et al. | 175/94 |
| 3,422,631 | 1/1969 | Silverman | 175/19 |
| 3,811,519 | 5/1974 | Driver | 175/73 |
| 3,840,270 | 10/1974 | Allgood | 299/14 |
| 3,853,186 | 12/1974 | Dahl et al. | 175/73 |
| 3,881,776 | 5/1975 | Fashbaugh et al. | 175/94 X |

FOREIGN PATENT DOCUMENTS

| | | | |
|---|---|---|---|
| 520,397 | 12/1953 | Belgium | 175/94 |
| 1,157,162 | 11/1963 | Germany | 175/19 |
| 1,104,468 | 4/1961 | Germany | 175/19 |

*Primary Examiner*—Ernest R. Purser
*Assistant Examiner*—Richard E. Favreau
*Attorney, Agent, or Firm*—Cushman, Darby & Cushman

[57] ABSTRACT

A method and apparatus for applying lateral thrust for moving a member, especially for applying lateral thrust to an earth penetrating device. A tubular mandrel of fixed length has four generally toroidal force cells disposed thereon, two laterally expandable force cells having a substantially constant radial dimension, the sum of the lateral dimensions of the lateral force cells always being the same, and two radially expandable force cells having a substantially constant lateral dimension. By alternately expanding and contracting the cells the mandrel is moved laterally. The radial cells engage the walls of a borehole during earth penetration to anchor themselves thereto when expanded. Any type of earth penetrating device may be placed in front of the lateral thrust applying unit, such as a drill bit or a compacting device. Adjacent lateral thrust applying units may be connected together by apparatus for allowing parallel or non-parallel orientation between adjacent units to provide for steering during earth penetration. The compacting device may take the form of a sharpened tip movable with respect to a conical rigid member having a plurality of inflatable cells of increasing diameter disposed thereon. Individual lateral cells of the lateral thrust applying unit may take the form of a piston disposed with clearance in a cylinder, and a flexible baglike membrane of a diameter smaller than or equal to that of the piston engaging the piston and cylinder, enough pressure always being supplied to the membrane to maintain it in tension.

33 Claims, 17 Drawing Figures

EARTH PENETRATION

BACKGROUND AND SUMMARY OF THE INVENTION

The invention relates in general to means and a method for applying a lateral thrusting force for movement of an assembly, and in particular to means for penetrating earth with a lateral thrust being applied thereto. It is a common problem in both vertical and horizontal drilling to provide sufficient lateral thrust for advancing a drill bit and the like. Prior art devices for supplying lateral thrust have in general been expensive, cumbersome, or unsuitable for a wide variety of applications. Also, directional control of the drilling mechanisms when lateral thrust applying mechanisms have been utilized has been difficult, requiring time-consuming orientation and deviation procedures.

According to the present invention, the problems associated with conventional prior art lateral thrust supplying and direction control providing means are solved. According to the present invention a lateral thrust mechanism is provided which employs elastomers and reinforcing material operated in tension, the unit relying only on stressed membrane strength and flow characteristics, rather than conventional structural design. This allows the device to flow over and around obstacles and to operate in physically deformed conditions which would cause structural failure or at least jamming of conventional hydraulic devices. At the same time, the mechanism according to the present invention can supply large lateral thrust forces both for vertical and horizontal drilling.

A lateral thrust unit according to the present invention takes the form of four hydraulically operated force cells (preferably toroidal) associated with a thrust mandrel (preferably tubular) of a given fixed length. Two of the force cells are lateral force cells, being expandable in the lateral direction, but being substantially of fixed dimension in the radial direction. The combined lateral dimension of the two lateral force cells always remains the same. The other two force cells are radial force cells, being expandable in the radial direction, but having a substantially constant lateral dimension. One radial force cell is disposed between the lateral force cells, while the other radial force cell abuts only one of the lateral force cells.

The cells operate to apply a lateral force by the transfer of the application points of thrust, and not through the expansion and contraction of the units themselves. A typical cycle of operation of the mechanism that would result in the lateral advance thereof (and any drill bit or the like attached thereto), a distance corresponding to the difference between the length of a lateral cell in the expanded and contracted positions thereof, is as follows: With the lead lateral cell expanded, the lead radial cell is expanded to engage the walls of the borehole securely, and effectively anchor itself to the borehole at that point. The lead lateral cell is then deflated, and the rear lateral cell correspondingly expanded to move the rear radial cell forward a distance corresponding to the difference in length between the rear lateral cell in its contracted and expanded positions. The rear radial cell is then expanded to engage the borehole walls, while the lead radial cell is contracted. Then the lead lateral cell is expanded while the rear lateral cell is contracted, to thereby move the lead portion of the mechanism forward a distance corresponding to the difference in length between a lateral cell in the expanded and contracted positions.

While the thrusting mechanism according to the present invention may take a wide variety of forms, preferably it consists of torodial force cells disposed around a tubular mandrel, and covered by an outer jacket of urethane rubber or the like, four such cells mounted on a mandrel comprising a muscle unit. Each lateral force cell may comprise a toroidal piston and a cylinder (formed by concentric tubes) which are movable with respect to each other, and an inflatable torodial flexible membrane disposed between the piston and cylinder for moving the piston and cylinder with respect to each other. The piston may be spaced from the cylinder along the whole periphery thereof, and the membrane doubled over in the space therebetween. The membrane may be of smaller deflated diameter than the piston, but will always be inflated enough to tension it so that it remains in contact with the cylinder interior walls and the piston. Other forms are, of course, possible, such as a conventional piston and cylinder. Each of the radial cells may be a conventional inflatable member constrained from movement in the lateral direction, but free to move radially. A means can be provided for introducing only a predetermined volume of fluid into the radial cell during expansion thereof. One radial cell, the one between the two lateral cells, will be slidably mounted with respect to the mandrel, while the other radial cell will be fixed with respect to the mandrel.

A plurality of lateral thrust applying members according to the present invention may be disposed together, the force being applied thereby being multiplied. The mechanisms are connected together by means for allowing parallel or non-parallel movement therebetween, such as a pair of steering rings having a plurality (i.e. 4) of inflatable steering cells disposed therebetween. By selective inflation of the steering cells, the elevation and azimuth of the penetrating device can be controlled.

A wide variety of earth penetrating tips and power supply means may be provided for use with an earth penetrating device utilizing the lateral thrust applying mechanism according to the present invention. Drill bits could be utilized, either powered from the surface through a drill string, or powered by down-hole motors or turbines. For soft earth penetration, a compactor may be utilized. According to the present invention, a compactor may be provided having a penetrating tip portion that is movable with respect to a compacting portion, the compacting portion having a plurality of inflatable cells of increasing diameter disposed around a conical rigid member. The cells are dimensioned so that the inflated diameter of one cell is equal to or greater than the deflated diameter of the next largest cell, so that a void formed by one cell may be filled by the next largest cell for further enlargement thereof. During operation, the penetrating tip is moved forwardly with respect to the compacting portion to form a small borehole, a lateral thrust is applied to the compacting portion (with cells deflated), with the tip retracted, to move it as far forward as possible into the area formed by the penetrating tip, the cells are inflated to increase the size of the hole diameter, and then the cells are deflated and the procedure repeated. The pressure applied to the cells is sufficient to cause the surrounding earth to compact upon itself, and may exceed, for example, 5,000 pounds per square inch. Since pressures such as this could exceed the free space rupture strength of the cells, the fluid is limited to a constant volume, well below the rupture volume of the cell. In this way, a hole is formed by compaction by repeated enlargement of each hole section by correspondingly larger penetrating portions.

It is the primary object of the present invention to provide improved means and methods for applying lateral thrust, and in particular to provide improved earth penetrating means and methods. This and other objects of the invention will become clear from an inspection of the detailed description of the invention, and from the appended claims.

BRIEF DESCRIPTION OF THE DRAWINGS

FIGS. *1a–1f* are diagrammatic side views of an exemplary muscle unit according to the present invention showing the sequential positions of various portions thereof during operation.

FIGS. *2a–2d* are perspective views of a number of exemplary earth penetration units utilizing the muscle unit of FIG. *1a;*

DETAILED DESCRIPTION OF THE INVENTION

Figures 1A, 1B, 1C, 1D, 1E, 1F:
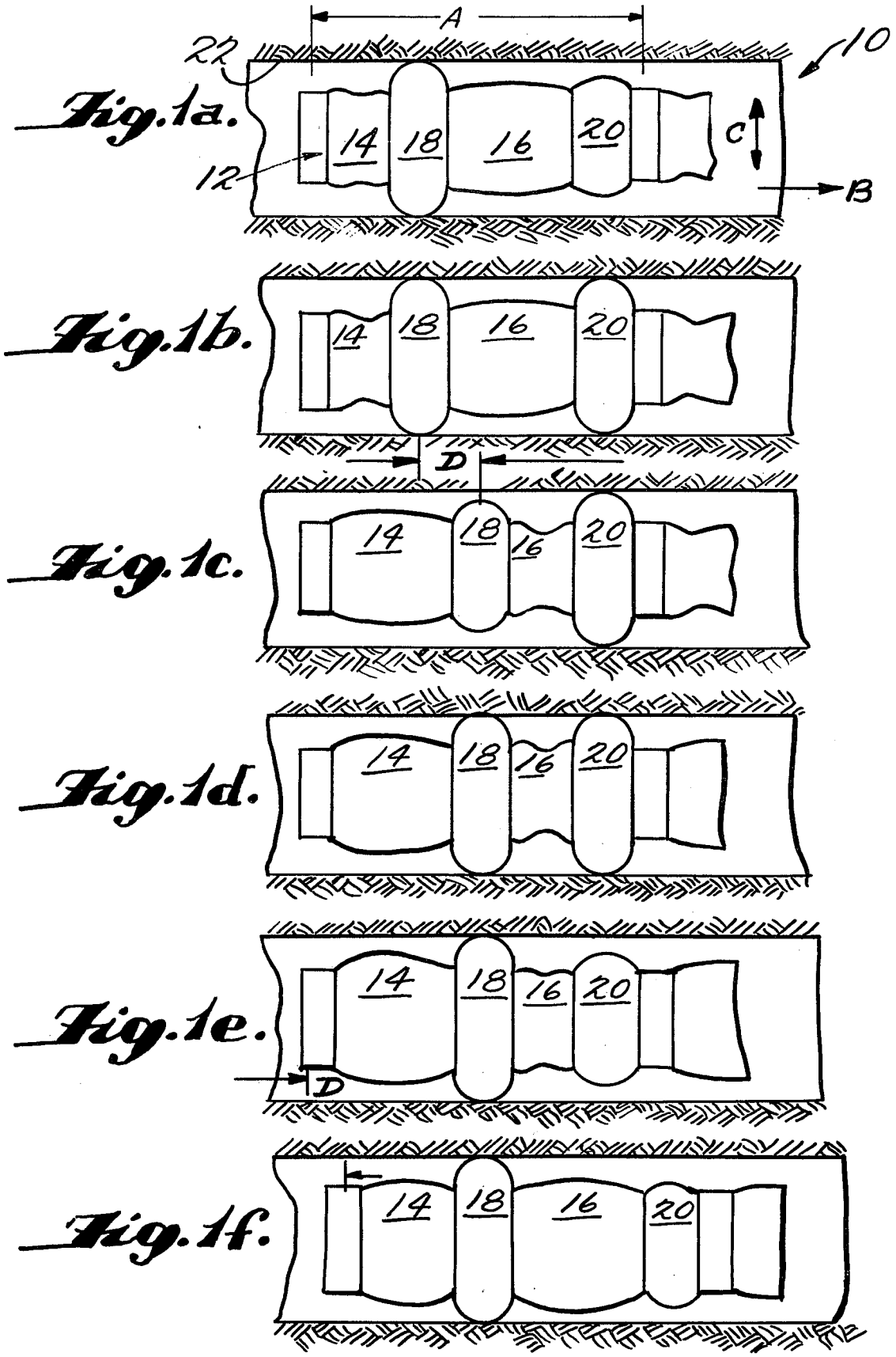
Figures 2A, 2B:
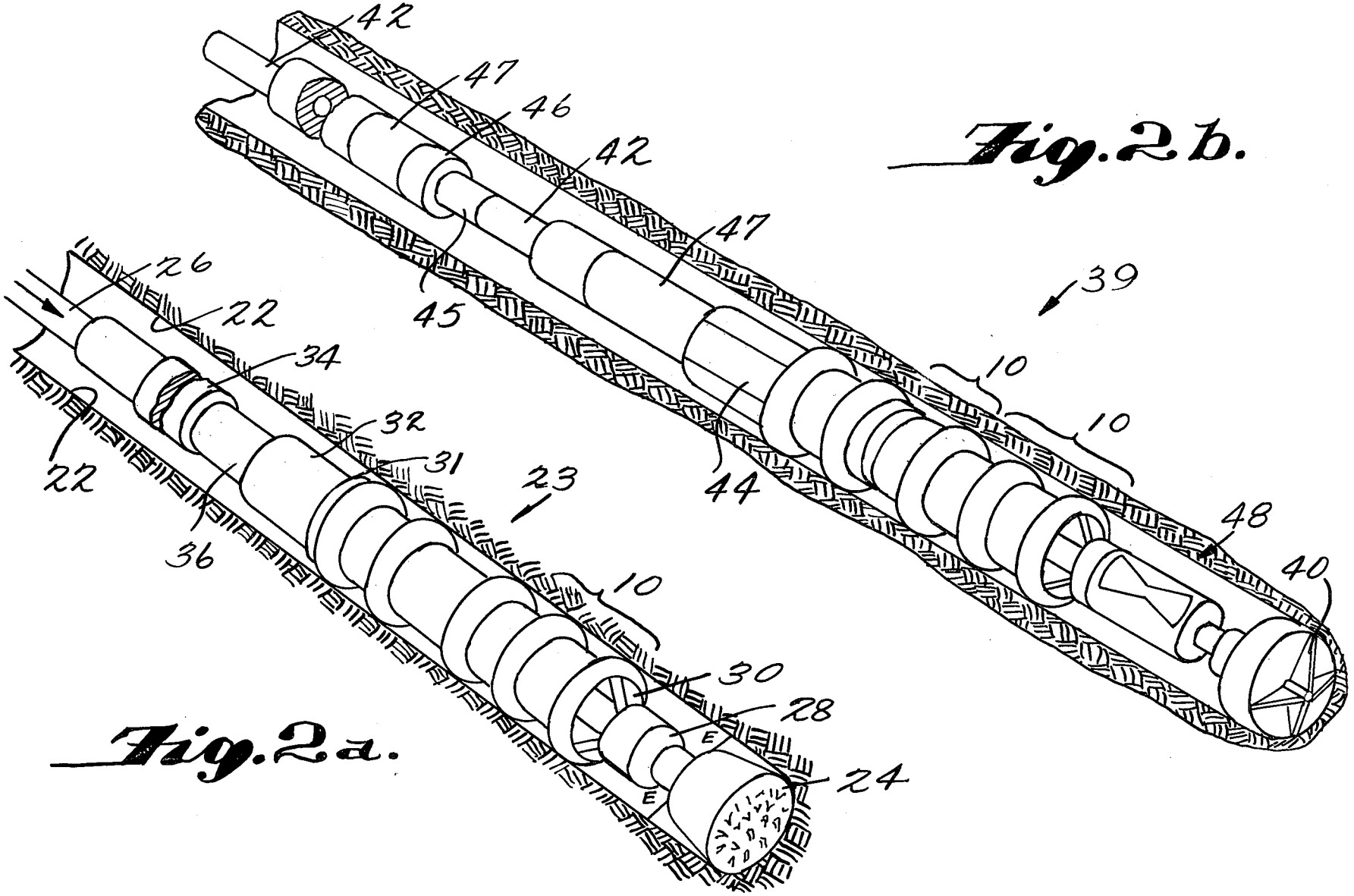
Figure 2C:
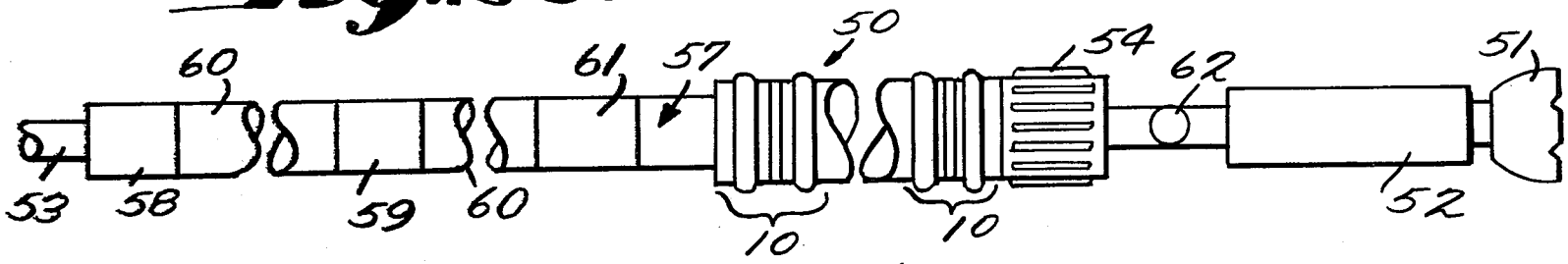

A muscle unit for supplying necessary lateral thrust forces for earth penetration and the like is shown diagrammatically at 10 in FIG. *1a,* and the sequence of operation thereof is shown in FIGS. *1a–1f.* Each muscle unit 10 consists of five major components, a thrust mandrel 12 having a given fixed length A, a pair of variable volume lateral force applying cells 14, 16 that may elongate in the lateral direction B, and a pair of variable volume radial force applying cells 18, 20 that may elongate in the direction C perpendicular to the direction B. The dimensions of the lateral cells 14, 16 in the radial direction C remain substantially constant despite the elongation thereof in the lateral direction B, while the dimensions of the radial cells 18, 20 remain substantially constant in the lateral direction B despite any elongation thereof in the radial direction C. The whole unit 10 is specially adapted to apply thrust forces in lateral direction B to a drill bit, compacting head, or other earth penetrating device during operation thereof, and the unit 10 operates in a borehole 22 formed by the penetrating device (see FIGS. *2a–2d*).

An exemplary mode of operation of the unit 10 of FIGS. *1a–1f* for lateral thrust force application is as follows: FIG. *1a* shows the unit 10 in a starting position wherein the radial cell 18 is expanded into contact with the borehole 22, lateral cell 16 is expanded, the lateral cell 14 and radial cell 20 are contracted. Radial cell 20 is then expanded so that it is in contact with borehole 22 (FIG. *1b*), and radial cell 18 is contracted (FIG. *1c*) so that the unit 10 is anchored to borehole 22 by cell 20. When radial cell 18 is contracted, lateral cell 16 is also contracted while lateral cell 14 expands, thus moving the radial cell 18 a distance D in the direction B, which distance D corresponds to the length of cell 14 expanded minus the length of cell 14 contracted (compare position of cell 18 in FIGS. *1b* and *1c*). With cell 18 in its new position it is expanded to again engage the borehole 22 and anchor itself thereto (FIG. *1d*), and cell 20 is then deflated (FIG. *1e*). The whole unit 10 is then ready to be advanced to a new position as cell 14 is contracted while cell 16 is expanded to the position shown in FIG. *1f.* The cell 18 provides a mechanism for transferring the reaction force of the lateral cell 16 from the unit 10 into the wall of the borehole 22. It will be seen that according to this mode of operation, the unit 10 has been advanced a distance D, and the cells 14, 16, 18, and 20 are in the same end positions (FIG. *1f*) as they were at the start of the cycle (FIG. *1a*). While a preferred sequence of operation has been described above, it is to be understood that the unit 10 may have many other modes of operation. Also, the order of cells on the mandrel could be varied as long as lateral and radial cells alternated.

The unit 10, according to the present invention, will thus be seen as an effective device for supplying thrust forces to earth penetration devices and thereby advancing the same. Any number of units 10 may be connected together in series to provide such forces, with a resultant force amplification. The lateral force (F) in direction B that will be applied by a series of muscle units 10 is equal to the number of muscle units (N), times the operating pressure differential of the units (P), times the cross-sectional area of a cell 14 or 16 (A'); that is $F = NPA'$.

The cells 14, 16, 18, and 20 of the units 10 may take any one of a number of forms suitable for accomplishing their designed functions, and the type of accessory earth-penetration equipment with which they may be utilized may take any one of a variety of forms. Exemplary forms that the earth penetrating equipment could take are shown in FIGS. *2a–2d.* The device 23 shown in FIG. *2a* is especially adapted for down-hole or vertical drilling. It includes a drill bit 24 (of diamond or the like) attached to the end of a drill string 26. Although a rotatable power shaft could be provided within the drill string 26 and the drill powered from the surface, it is preferred that the drill bit 24 be driven by a positive displacement down-hole motor 28. The motor extends from the drill bit 24 into an interior cavity formed by the muscle units 10 (as will be more fully explained hereinafter). Drilling fluid may pass through the interior of the drill string and into the area E adjacent the bit 24, pick up loose material, and pass back through fluid return annuli 30, 31 and back to the surface. The units 10 may be powered by any suitable means, such as a self-contained electrohydraulic package at 32, or they may be powered by the drilling fluid, control of valving being provided by battery-powered controls or the like located at 32. A turbine could be utilized for driving a hydraulic pump, or the pressure for operation could be extracted from the pressure differential between the drill string 26 and the fluid return. The control unit for the units 10 may comprise a wire-line-recoverable probe which is pumped down the center of the drill string 26, and having pre-set battery-powered controls for regulating the magnitude and direction of the thrust supplied by the units 10, as well as the timing sequence of its pulsations. Existing wire line telemetry systems could be utilized, or remotely operated two-way wireless telemetry along the drill string could be employed. The control logic may also be solid state electrical, fluid logic, or rotary valve. An instrumentation, survey, and telemetry package could be located at 34 between non-magnetic drill collars 36.

The control and earth penetration units on either side of the muscle units 10 according to the present invention can take a wide variety of forms, as exemplified by the structures of FIGS. *2b–2d*. The device 39 of FIG. *2b* is especially adapted for horizontal drilling, for instance into a coal seam. A drag bit 40 powered by a rotating drill string 42 which is operated from the surface may provide the earth penetration for the device. A suitable worm power package could be located at 44, and a suitable instrumentation package 45 could be located at 46. The instrumentation package 45 is located in a plenum chamber in section 46 of the device. Non-magnetic drill collars 47 are provided on either side of the instrumentation package 45 in order that the drill string does not interfere with the electronic equipment package 45. A slot type rotating radar antenna 48 is provided adjacent the drag bit 40 to provide a coal or ore seam centering and a contour following capability for the horizontal drilling device of FIG. *2b*. The antenna 48 generates a broad directional beam which rotates with the drill string 42, and the radar (which could be either electromagnetic or acoustic) return enables the system to establish the distance from both the roof and floor of an ore or coal seam. As in the other embodiments the muscle units 10 supply lateral thrust to the drill bit. Also, since the muscle units 10 pull the drill string 42 behind them the drill string 42 is always in tension just as in vertical drilling. Preferably, the instrumentation package 46 is not truly an integral part of the down-hole portion of the device since it is preferably connected to the main body of the device only through breakaway connectors (not shown). Thus, in the event that the device becomes stuck in a hole, the instrument package 45, which would normally be the most expensive portion of the device, can be salvaged by pumping a standard over-shot on a wire-line down the center of the drill string 42, the over-shot attaching itself to a fishing head on the instrument package 45, and then withdrawing the wire-line, the instrument package 45 breaking loose from connection in portion 46.

The device 50 of FIG. *2c* could be utilized for both down-hole and horizontal drilling. A bit 51, of any conventional type, is powered by a turbine 52 or the like which is operatively connected to a drill string 53. Lateral thrust muscle units 10 again provide the thrust for the drill bit, and angular orientation of the device 50 may be provided by a rotary muscle unit arrangement 54 or the like. The unit 54 operates in substantially the same manner as the axial thrust units 10, only all of the individual cells are arranged in a circle. By controlling the cells of the arrangement 54, the angular orientation of the device 50 can thus be adjusted. Again suitable controls 57 for the muscle units 10 could be provided as well as signal conditioning telemetry 58. A three axis accelerometer 61 and a three axis magnetometer 59 could also be provided to generate navigational information for the device, the magnetometer 59 connected to the rest of the device 50 by non-magnetic collars 60. A kick or bent sub 62 could operatively connect the turbine 52 with the rotary muscle arrangement 54.

A device 65 especially adapted for penetration of soft earth by compaction is shown in FIG. *2d*. Again, a plurality of muscle units 10 are provided for exerting lateral thrust, and the units 10 may be controlled by a high pressure hydraulic package with controls 67, with a submersible electric pump motor 68 having high H. P. and low diameter being utilized for providing the driving force. An electric power and telemetry cable 69 need be the only connection between the device 65 and the surface, no drilling fluid or the like being necessary in this embodiment since there are no cuttings or loose earth to be removed. The penetrating unit 70 disposed at the leading end of the units 10 actually effects the penetration of the earth and the enlargement of the hole 22 to allow the units 10 and associated structure to penetrate. The basic components of the unit 70 consist of a penetration ram 72 (having a sharpened tip 73), and a plurality of generally torodial inflatable cells 74 that increase in diameter from the ram 72 toward the muscle units 10 and are disposed around a rigid conical member 75. To penetrate soft earth by compaction, the ram 72 with pointed conical tip 73 thereon is moved forward relative to the cells 74 to penetrate the ground, while the cells 74 are deflated (see FIG. *6a*). Then the muscle units 10 move the cells 74 forwardly with respect to the tip 73 until the position shown in FIG. *6b* is achieved, the tip being retracted at the same time. Then the cells are inflated, either sequentially or all at once, and they compact the earth surrounding them, each individual cell 74 compacting the earth to such an extent that the next largest cell 74 of the group can pass into the void created by the smaller cell when the larger cell is deflated. With reference to FIG. *6c*, cell 74', when expanded, compacts the earth therearound so much that cell 74'', which is slightly larger than cell 74', can take the position of cell 74' when it is deflated and the group of cells 74 are moved forwardly. Although the above sequence of operation is preferred, there are many other sequences of operation that may be performed with the device 65 for earth penetration.

Figure 5:
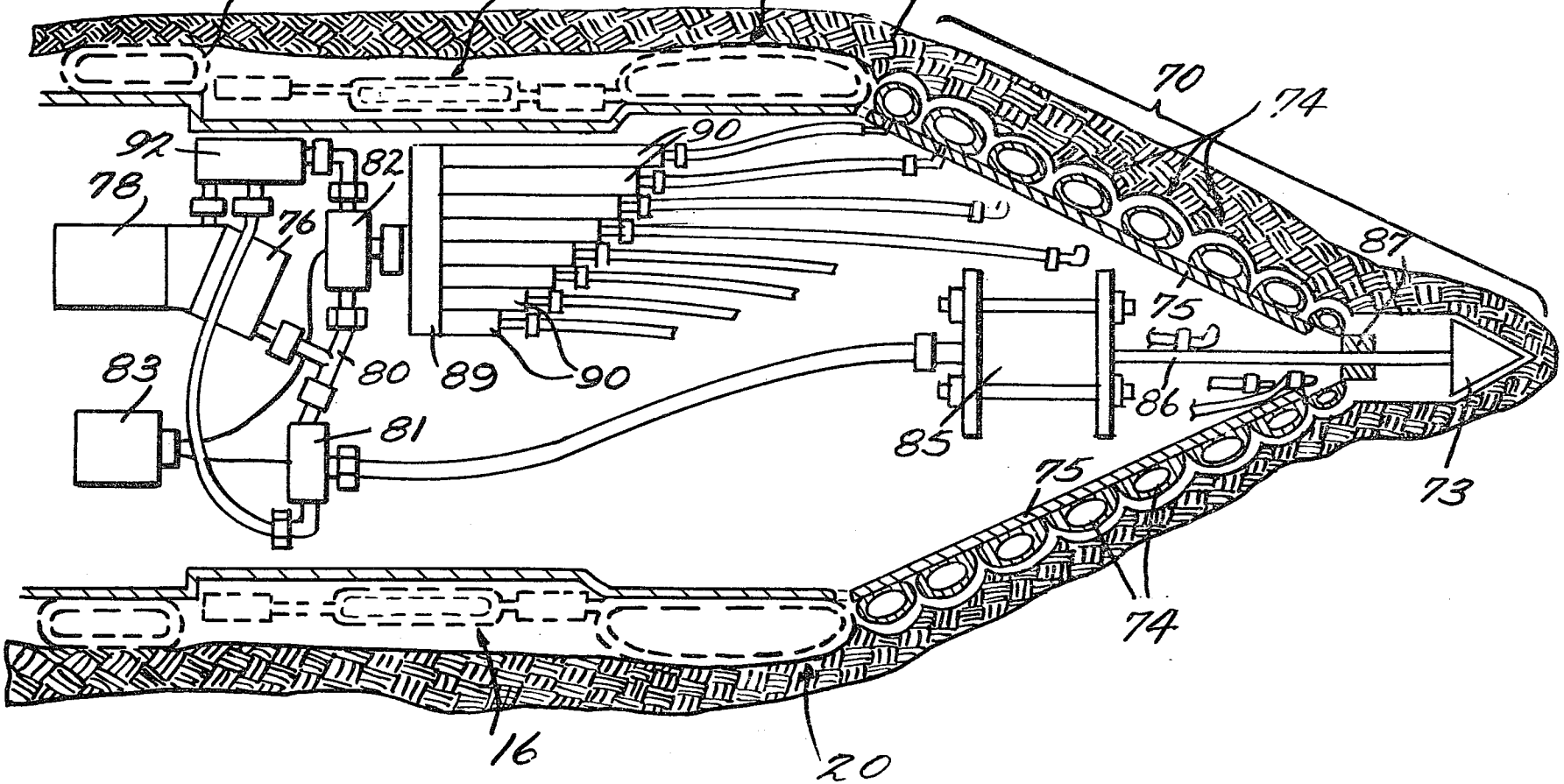
FIG. 5 is a cross-sectional view of the front portion of the drilling unit of FIG. *2d;* and FIGS. *6a–6d* are diagrammatic side views of the compacting portion of the penetrating unit of FIG. 5 showing the sequential positions of various portions thereof during operation.
Figure 6B:
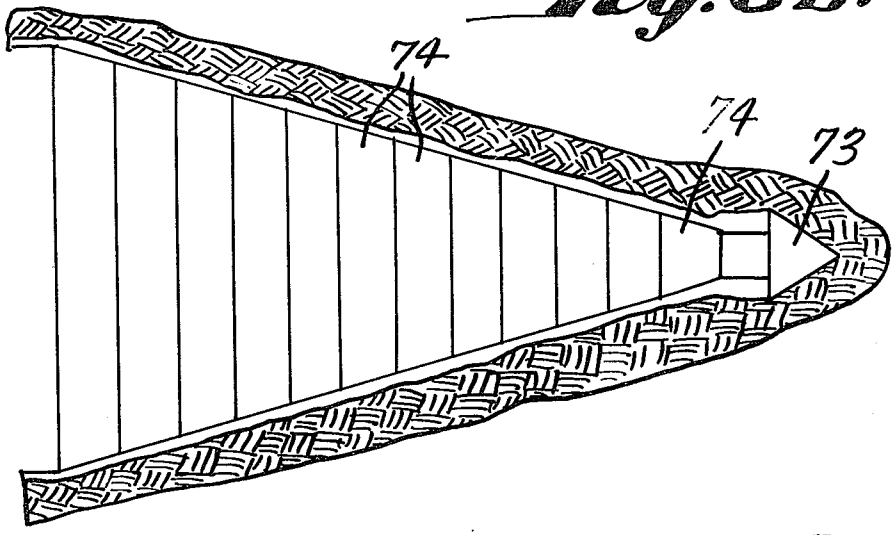
Figure 6D:
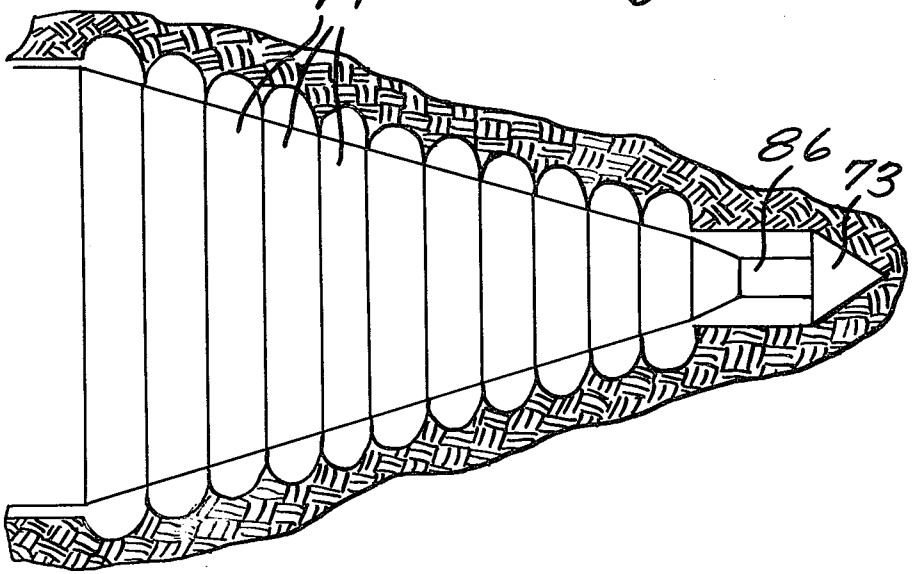
Figure 6A:
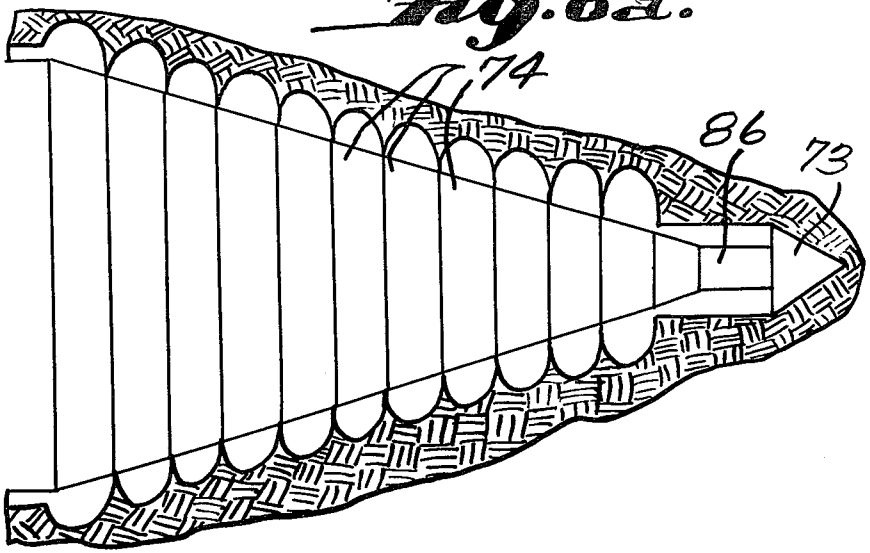
Figure 6C:
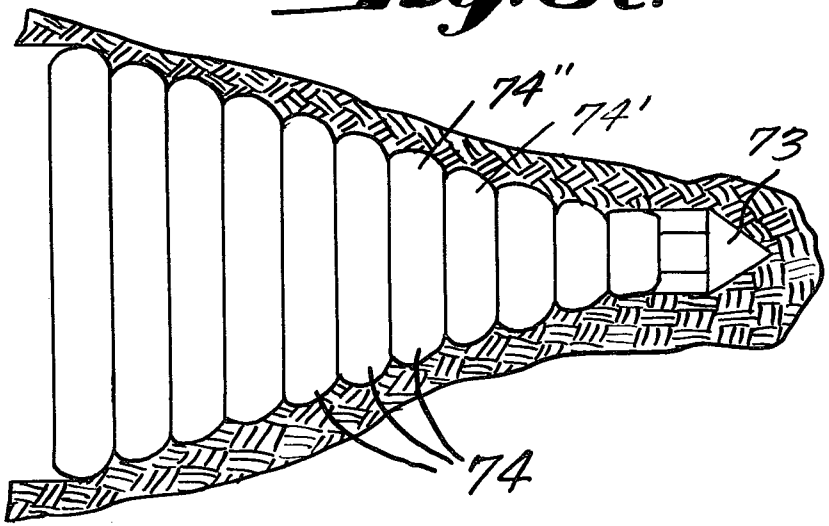

A cross-section of the forward portion of the device 65 of FIG. *2d* is illustrated in FIG. 5. A high pressure hydraulic pump 76 or the like provides the force both for movement of the ram 72 and expansion of the cells 74. The pump 76 is driven by an electric motor 78 or the like, which motor is connected to the surface via the cable 69. High pressure hydraulic fluid is delivered from pump 76 to a manifold 80, which in turn feeds the fluid to two four-way cylinder valves 81, 82 or the like. The valves 81, 82 are controlled by an electronic timing unit 83, which in turn may be controlled by the instrumentation 67 for the device 65. Valve 81 controls the flow of hydraulic fluid to a thrust cylinder 85 which forms part of the ram 72, along with shaft 86 and tip 73. It is preferred that the shaft 86 is spring-loaded so that tip 73 is retracted when no fluid is supplied to cylinder 85. When fluid is supplied to cylinder 85 from valve 81, the shaft 86 is reciprocated in direction B, being guided by bushing 87 of member 75, and the tip 73 is thus moved with respect to the cells 74 and member 75. Upon removal of the fluid from cylinder 85, the tip 73 retracts so that it is in engagement with bushing 87.

Valve 82 controls the supply of fluid to the cells 74. Valve 82 is connected to a manifold 89, which in turn is connected to a plurality of individual metering units 90. Each unit 90 is designed so that when hydraulic pressure is applied thereto it will transfer only a fixed given volume of fluid at the applied pressure to a cell 74 with which the unit 90 is operatively connected. The applied pressure is sufficiently high, perhaps 5,000 pounds per square inch or even more, to insure that the cell will cause the surrounding earth to compact upon itself. When this specific volume of fluid has been transferred, the unit 90 will automatically shut off, and will allow further flow. The amount of fluid transferred by each metering unit 90 is adjusted so that the individual cells 74 will expand to a size larger than the unexpanded size of the next largest cell 74 of the group, but so that the expansion volume is well below the free space rupture volume of the cell 74. When the valves 81, 82 are deactivated, return channels are opened which allow fluid to flow back from the units 90 through the valve 82, and from the cylinder 85 through the valve 81, to an accumulator 92, from whence the fluid can be pumped when the cycle is repeated. The operation of the muscle units 10 is coordinated with the operation of the unit 70 by the control package 67 so that forward thrust of the unit 70 takes place when the tip 73 is retracted and the cells 74 deflated.

While a preferred embodiment of a compacting device has been shown in FIG. 5, it is to be understood that the action of earth compaction and lateral thrust generation may be combined as by sequentially increasing the diameter of each succeeding muscle unit, and by using the radial locking cells to provide the required earth compaction.

Figure 3:
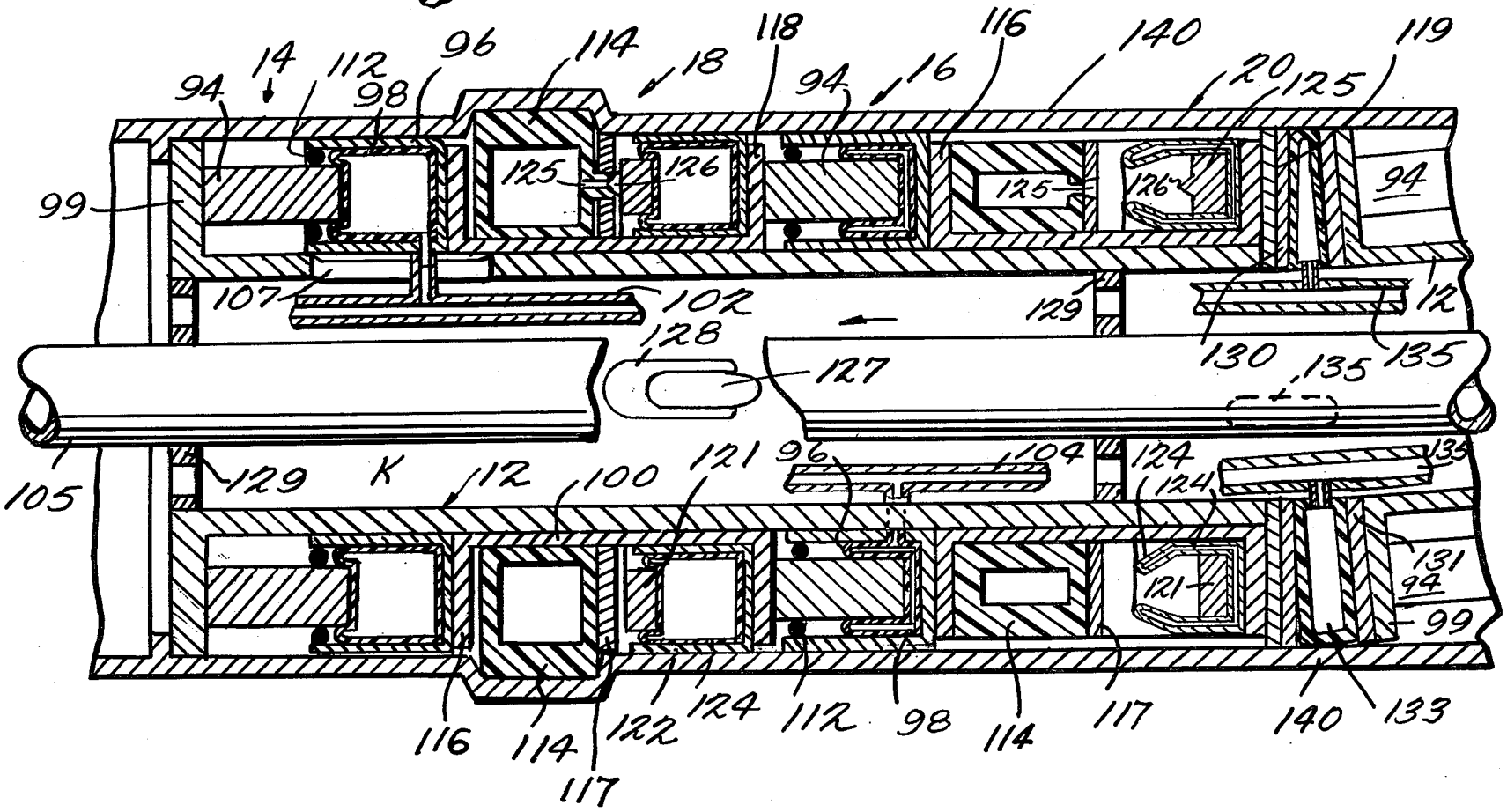
FIG. 3 is a cross-sectional view of the muscle unit of FIG. *1e;*

An exemplary form that a muscle unit 10, that is utilized with the earth penetration devices of FIGS. *2a–2d*, could take is shown in FIG. 3. The cells 14, 16, 18, and 20 in FIG. 3 are shown in the same position as in FIG. *1e*. Each of the two lateral thrust cells 14, 16 includes a piston 94, a cylinder 96, and a membrane 98. The cell 14 is shown in its expanded position, and the cell 16 in its retracted position in FIG. 3. The pistons 94 are ring-like, as are the cylinders 96; the cylinders 96 comprise means associated with the lateral force cells 14, 16, for restricting the radial expansion thereof so that the lateral force cells 14, 16 have a substantially constant radial dimension. The piston 94 of cell 14 is rigidly attached to the force ring 99 of mandrel 12, while piston 94 of cell 16 is attached to slidable carriage 100. Fluid is supplied to the interior of membranes 98 for operation of the respective lateral thrust cells by hydraulic lines leading from the control and power system for the units 10 (such as shown at 31, 44, and 67 in FIGS. *2a, 2b*, and *2d*) to hydraulic manifolds 102, 104 operatively connected to cylinders 96 of cells 14 and 16 respectively, or by other means which directly obtain the driving force for the units 10 from the flow of drilling fluid through the drill string 105. The manifold 102 is offset 180° with respect to the manifold 104 so that there is no interference therebetween. Since carriage 100 and piston 96 of cell 14 are "floating" with respect to the mandrel 12, a displacement slot 107 is provided in mandrel 12 for manifold 102 since it will move with respect to mandrel 12, while manifold 104 is fixed to mandrel 12.

Figure 4:
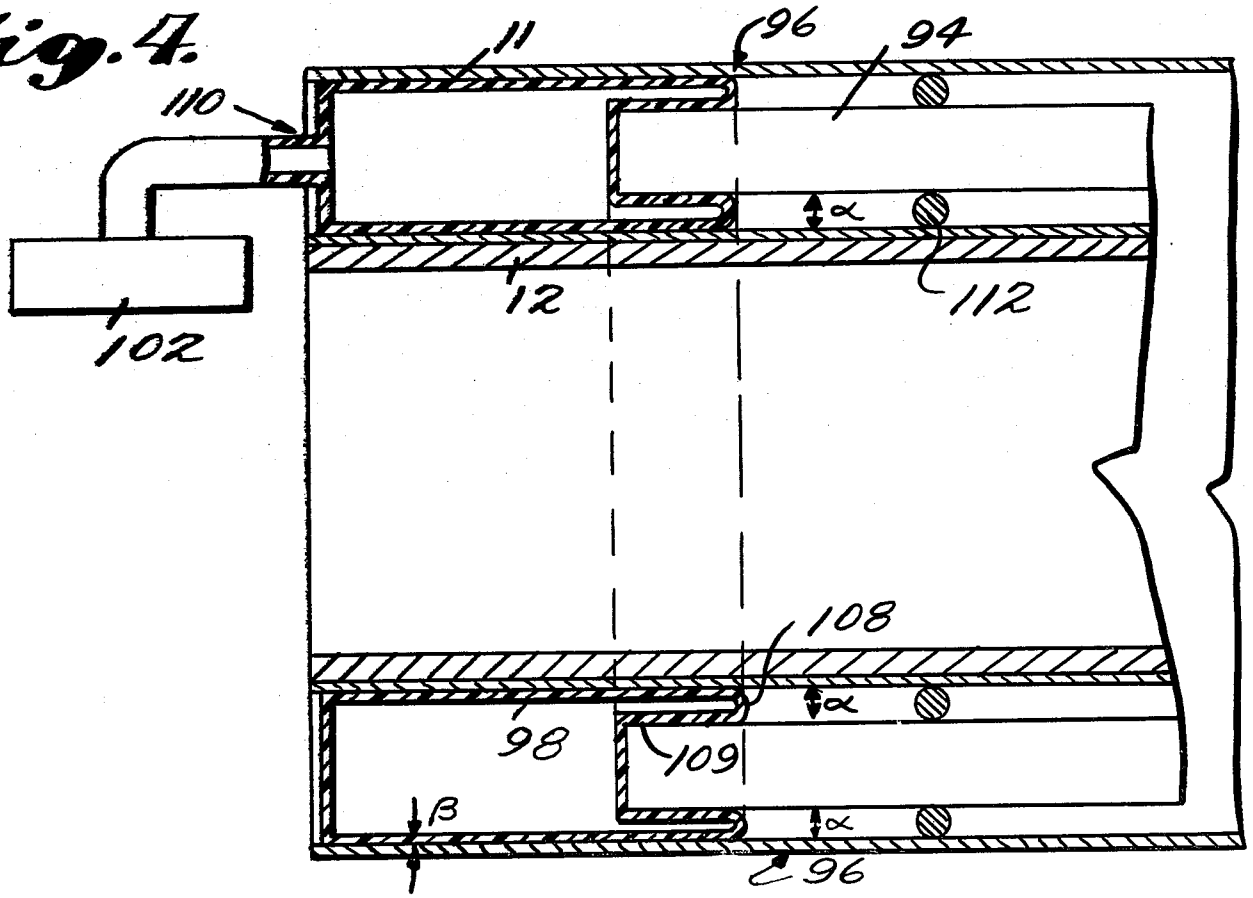
FIG. 4 is a cross-sectional view of an exemplary individual force unit utilizable in the muscle unit of FIG. 3.
Figure 2D:
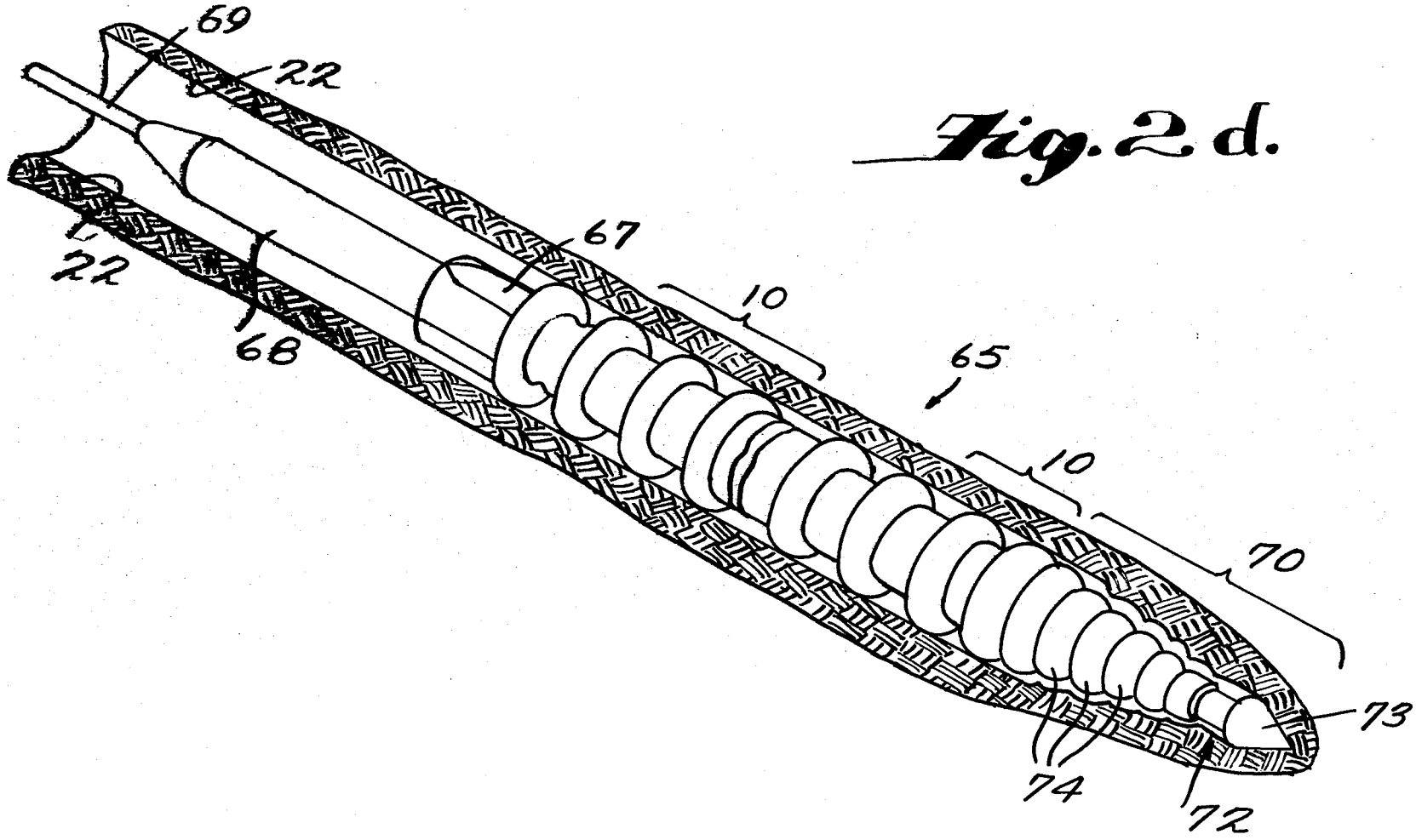

An exemplary membrane 98, made of urethane rubber or other elastomer, that may be utilized in the lateral thrust cells 14, 16 is shown in detail in FIG. 4. The membrane 98 is generally toroidal in shape and is doubled over inbetween the cylinder 96 and the annular piston 94, having a convolution 108. If the distance between the cylinder 96 and the piston 94 around the whole periphery of cylinder 96 is $\alpha$ and the thickness of the membrane is $\beta$, then $\alpha > 2\beta$ and preferably $\alpha \cong 3\beta$. The unexpanded diameter of the membrane 98 is selected so that it is less than the diameter of the cylinder 96, and less than or equal to the piston diameter, however fluid under pressure is always supplied to the membrane 98 of sufficient magnitude to retain the membrane 98 in tension, and in contact with the interior walls 111 of the cylinder 96, and a portion 109 thereof in contact with piston 94. While the inlet 110 for hydraulic fluid for pressurizing the membrane 98 is shown in FIG. 4 to be at an end wall of the cylinder 96, it could be located at other places along the length of the membrane (as shown in FIG. 3) as long as it did not interfere with the movement of piston 94. O-ring spacers 112 may be provided on pistons 94 if desired. These O-rings do not serve the normal sealing function of O-rings, but are used to absorb any non-axial forces and transfer them through each piston 94 to thrust mandrel 12 without disturbing the annular spacing required for the convolution 108 of the membrane 98 of the thrust cells.

The radial locking cells 18, 20 have a substantially fixed dimension in the direction of movement B of the unit 10, the cell 18 being mounted in a movable (with respect to mandrel 12) carriage 100, while the cell 20 is rigidly attached to the mandrel 12 by annular plates 111, 112. Each radial cell contains a flexible hollow member 114 which is prevented from expanding in the axial direction, but is allowed to expand in the radial direction. Rings 116, 117 of cells 18, 20 prevent the flexible hollow toroidal members 114 from expanding in the lateral direction, rings 116, 117 of cell 18 being rigidly attached to movable carriage 100, and rings 116, 117 of cell 20 being rigidly attached to mandrel 12. When fluid under pressure is supplied to the members 114, they thus expand in the radial direction.

Although hydraulic fluid may be supplied directly from lines from a control power package (i.e. 32 in FIG. *2a*) to member 114, a constant volume means can be used for applying the pressure to apply the pressurizing fluid. Such means are shown at 120 in FIG. 3. The constant volume cells may be constructed substantially the same as the lateral force cells 14, 16, having a piston 121 slidable in a cylinder 122, the lateral extremities of the cylinders 122 being defined by annular plates 117, 118 of slidable carriage 100 in the case of cell 18, and by annular plates 117, 119 in the case of cell 20. Each plate 117 has an opening 125 therein to allow passage of fluid therethrough. Fluid applied to the membranes 124 in cylinders 122 causes the pistons 121 to move laterally, thereby compressing the fluid in cylinders 122 and forcing it through openings 125 into members 114. After the pistons 121 reach the plates 117 which define the end of their path of travel, the sealing end portions 126 of pistons 121 engage the fluid openings 125 in plates 117, and do not allow any more fluid to flow into members 114. Thus, only a certain volume of fluid—the volume of cylinder 122—will be allowed to flow into members 114 during any operation thereof. Hydraulic manifolds may be utilized to supply the operating fluid to membranes 124. Manifold 127 supplies cell 18, and since cell 18 is mounted on slidable carriage 100, a displacement slot 128 is provided in thrust mandrel 12 to accommodate relative movement between cell 18 and mandrel 12. Since cell 20 is fixed with respect to mandrel 12, the manifold supplying it (not shown, but located 180° around mandrel 12 with respect to manifold 127) is also fixed with respect to mandrel 12.

As shown in FIG. 3, when the unit 10 is used as part of an earth penetrating device, drilling fluid may flow from the surface through the interior of drill string 105 to the area of drilling, and it can return in the area K within unit 10 between the mandrel 12 and the drill string 105, the string 105 being spaced from mandrel 12 by a number of spider members 129. When a plurality of units 10 are to be affixed together, especially for earth penetration where directional control is desirable, a means for controlling parallelism or non-parallelism between the connected units 10 is required. This is preferably accomplished by providing a first steering ring 130 attached to one unit 10, and a second steering ring 131 attached to the adjacent unit 10, with means for controlling the planar angle therebetween. While the angle controlling means may take any of a wide variety of forms (such as hydraulic cylinders, electrically driven reciprocating devices, etc.), according to the present invention it is preferred that a plurality of fluid-actuated steering cells 133 be provided between steering rings 130, 131. A minimum of three cells 133 must be provided since it takes 3 points to establish a plane, however it is preferred that four cells 133 be provided so that standard coordinate control may be effected. Fluid for actuation of cells 133 is selectively provided to cells 133 by manifolds 135 (corresponding to the number of cells 133). When four cells 133 are provided, one pair of opposite cells will control the elevation of the earth penetration device with which they are associated, while the other pair of opposite cells will control the azimuth of the device.

The connected muscle units 10, according to the present invention, are covered with a flexible outer jacket 140. The jacket 140 protects the components of the cells, and provides for ease of passage thereof through the borehole. The outer jacket 140 preferably is made of urethane rubber because of its toughness, good elongation, and high abrasion resistance, however any elastomer with good toughness, elongation, and abrasion resistance characteristics may be utilized.

While the muscle unit of the invention has been described herein specifically for use with a wide variety of earth penetrating devices, it is to be understood that it may have many other applications, such as for ground transport or any other application where a lateral thrusting force is desired.

While the invention has been herein shown and described in what are presently conceived to be the most practical and preferred embodiments of the invention, it will be apparent that many modifications may be made thereof within the scope of the invention, which scope is to be accorded the broadest interpretation of the appended claims so as to encompass all equivalent structures, devices, and methods.

What is claimed is:

1. An assembly for providing lateral thrusts in an area having a confined radial dimension, said assembly comprising (a) a generally tubular mandrel of a fixed lateral length, (b) a pair of generally toroidal lateral force cells mounted on and surrounding said mandrel and each being expandable and retractable in said lateral direction, the combined length in the lateral direction of said lateral force cells being a fixed amount less than the length of said mandrel, each of said lateral force cells having means associated therewith for restricting the radial expansion thereof so that each of said toroidal lateral force cells has a substantially constant radial dimension, (c) a pair of generally toroidal radial force cells mounted on and surrounding said mandrel each having a substantially fixed lateral dimension but being expandable in the radial direction, (d) said radial and lateral toroidal force cells being alternately disposed on said mandrel, and (e) means for selectively expanding or contracting said force cells for movement of said assembly in the lateral direction.

2. An assembly as recited in claim 1 wherein each of said lateral force cells includes a piston, a cylinder, and a flexible membrane abutting said piston and the interior walls of said cylinder, said flexible membrane for moving said piston and cylinder with respect to each other, and wherein said means for selectively expanding said force cells does so by applying fluid under pressure thereto.

3. An assembly as recited in claim 2 wherein said flexible membrane has an uninflated diameter equal to or smaller than the diameter of said piston, and wherein said means for applying fluid pressure always supplies sufficient pressure to the interior of said membrane to place it in tension so that it engages the interior walls of said cylinder and said piston.

4. An assembly as recited in claim 3 wherein said flexible membrane has a convolution in an area thereof wherein the piston and cylinder overlap, said convolution being disposed in an area between said piston and cylinder around the periphery of said piston, said piston and cylinder being spaced a radial distance $\alpha$, and the thickness of said flexible membrane being $\beta$, and $\alpha$ being greater than $2\beta$.

5. An assembly as recited in claim 4 wherein said piston is annular and said cylinder formed by concentric tubes, and wherein said flexible membrane is torodial.

6. An assembly as recited in claim 1 wherein said radial cell disposed between said lateral cells is mounted for slidable movement with respect to said mandrel.

7. As assembly as recited in claim 6 wherein a rigid annular member having rigid lateral side plates on either side thereof is slidably mounted on the exterior surface of said mandrel and mounts a radial force cell disposed between said lateral force cells thereon, between said side plates.

8. An assembly as recited in claim 6 wherein a hydraulic thrust manifold is provided for supplying fluid under pressure to each of said force cells, and wherein the manifold for supplying fluid under pressure to said radial cell disposed between said lateral cells is movable with respect to said mandrel and is disposed in a slot in said mandrel, and the manifold for supplying the lateral cell which is not disposed between two radial cells is also movable with respect to said mandrel and disposed in a slot in said mandrel, and wherein the manifolds for the other radial and lateral cells are rigidly attached to said mandrel.

9. A ground penetrating device for forming a borehole, from a ground surface, having radial and lateral dimensions and continuously penetrating the ground by elongation of the borehole, said device comprising (a) a tip portion for penetrating the ground to form the borehole, (b) a plurality of means for applying lateral thrust to said tip portion for providing a penetrating force thereto, each of said lateral thrust applying means comprising (i) a generally tubular mandrel of a fixed length, (ii) a pair of generally toroidal lateral force cells mounted on said mandrel and each being expandable and retractable in said lateral direction, the combined length in the lateral direction of said lateral force cells being a fixed amount less than the length of said mandrel, and each of said lateral force cells having a substantially fixed radial dimension, the radial expansion thereof being restricted to said radial dimension, (iii) a pair of generally toroidal radial force cells mounted on said mandrel and having a substantially fixed lateral dimension but being expandable in the radial direction from a first position wherein the walls of the borehole are not engaged thereby, to a second position wherein the walls of the borehole are securely engaged thereby and said cell is effectively anchored to the borehole walls at the area of engagement with said walls, (iv) said radial and lateral force cells being alternately disposed along said mandrel and adjacent one of said plurality of means for applying lateral thrust having alternate lateral and radial cells, and (v) means for slectively applying fluid under pressure to said force cells to provide alternate expansion and contraction thereof for movement of said entire lateral thrust applying means in the lateral direction for applying a lateral thrust, (c) means for connecting said plurality of lateral thrust applying means together so that the lateral thrust supplied thereby is cumulative, and (d) means leading from said thrust applying means to the surface of ground penetrated by said device.

10. A ground penetrating device as recited in claim 9 wherein said means for selectively applying fluid under pressure to said force cells provides pressure so that at least one of said radial cells is always expanded and so that one of said lateral cells is expanded and one is contracted at all times.

11. A device as recited in claim 9 further comprising a lateral thrust applying means power package and control means disposed on the side of said thrust applying means opposite said tip portion.

12. A device as recited in claim 9 wherein said tip portion comprises a drill bit and wherein means are provided for rotating said drill bit.

13. A device as recited in claim 12 wherein said means for rotating said drill bit comprises a down-hole motor.

14. A device as recited in claim 12 wherein said means for rotating said drill bit comprises a rotatable drill string extending from the surface through the interior cavity of said tubular mandrel to said drill bit.

15. A device as recited in claim 14 wherein drilling fluid passes through said drill string toward said drill bit, and returns from said drill bit to the surface in the area between said drill string and interior of said mandrel, and wherein said drill string is supported by said mandrel by a plurality of spiders.

16. A device as recited in claim 12 further comprising a drill string extending from the surface through said hollow interior portion of said mandrel and to said penetrating tip, and wherein instrumentation package is disposed in a plenum associated with said drill string, and is releasably connected to said drill string and is of such a size that it can be retracted to the surface through the center of said drill string.

17. A device as recited in claim 16 wherein the plenum for containing said instrumentation package is connected to said drill string on either side thereof by non-magnetic collars, and wherein said instrumentation package is releasably connected to said drill string.

18. A device as recited in claim 9 wherein said penetrating tip portion comprises a sharpened tip means capable of penetrating soft earth when a lateral thrust is supplied thereto, for forming a bore of a given diameter, means for supplying lateral thrust to said sharpened tip means, and earth compacting means associated with said tip means for expanding the diameter of a bore formed by said tip means by compacting earth adjacent the bore, said tip means being movable with respect to said compacting means.

19. A device as recited in claim 18 wherein said earth compacting means comprises a generally conically shaped rigid member, a plurality of individual inflatable cells disposed about said rigid member and having diameters that increase from said tip portion toward said lateral thrust applying means for said whole device, each of said individual cells having an inflated diameter substantially the same as or larger than the deflated diameter of the next larger cell, and means for selectively applying fluid under pressure to said inflatable cells.

20. A ground penetrating device for forming a borehole, from a ground surface, having radial and lateral dimensions and continuously penetrating the ground by elongation of the borehole, said device comprising (a) a tip portion for penetrating the ground to form the borehole, (b) a plurality of means for applying lateral thrust to said tip portion for providing a penetrating force thereto, each of said lateral thrust applying means comprising (i) a generally tubular mandrel of a fixed length, (ii) a pair of generally toroidal lateral force cells mounted on said mandrel and each being expandable and retractable in said lateral direction, the combined length in the lateral direction of said lateral force cells being a fixed amount less than the length of said mandrel, and each of said lateral force cells having a substantially fixed radial dimension, (iii) a pair of generally toroidal radial force cells mounted on said mandrel and having a substantially fixed lateral dimension but being expandable in the radial direction from a first position wherein the walls of the borehole are not engaged thereby, to a second position wherein the walls of the borehole are securely engaged thereby and said cell is effectively anchored to the borehole walls at the area of engagement with said walls, (iv) said radial and lateral force cells being alternately disposed along said mandrel and adjacent ones of said plurality of means for applying lateral thrust having alternate lateral and radial cells, and (v) means for selectively applying fluid under pressure to said force cells to provide alternate expansion and contraction thereof for movement of said entire lateral thrust applying means in the lateral direction for applying a lateral thrust, (c) means for connecting said plurality of lateral thrust applying means together to provide for steering of said device by allowing either parallel or degrees of non-parallel disposition between said mechanisms, and (d) means leading from said thrust applying means to the surface of ground penetrated by said device.

21. A device as recited in claim 20 wherein said steering connecting means comprise a steering ring attached to each of adjacent connecting mechanisms, and means disposed between said steering rings for changing the angle of the planes of the surfaces thereof.

22. A device as recited in claim 21 wherein said means for changing the angle of the planes of the surfaces of said steering rings comprises three or more inflatable steering cells, and means for supplying fluid under pressure to said steering cells.

23. A soft ground penetrator comprising (a) a sharpened tip means capable of penetrating soft earth when a lateral thrust is supplied thereto for forming a bore of a given diameter, (b) means for supplying lateral thrust to said sharpened tip means, (c) earth compacting means associated with said tip means for expanding the size of a bore formed by said tip means by compacting earth adjacent the bore formed by said tip means, said tip means being movable with respect to said earth compacting means, said earth compacting means comprising a generally conically shaped rigid member, a plurality of individual inflatable cells disposed about said rigid member and extending in increasing diameter from said tip means toward said means for supplying lateral thrust to said compacting means, each of said cells having an inflated diameter substantially the same as or larger than the deflated diameter of the next larger cell, and means for selectively applying fluid under pressure to said inflatable cells, and d) means for supplying lateral thrust to said earth compacting means to provide for lateral movement thereof.

24. A penetrator as recited in claim 23 wherein said means for supplying lateral thrust to said tip means is disposed within said conical rigid member and includes a hydraulic cylinder mounted to the inside of said conical member, and wherein means for providing fluid under pressure to said hydraulic cylinder provide for movement of said tip means relative to said earth compacting means.

25. A penetrator as recited in claim 23 wherein said means for applying fluid under pressure to said cells comprise means for supplying a constant volume of fluid under pressure to a cell associated with each of said cells, the constant volume of fluid being applied in each case being less than that which would rupture a given cell but great enough to provide inflation of the given cell to a diameter greater than the deflated diameter of the next largest cell.

26. A force applying device comprising (a) a cylinder, (b) a piston disposed in said cylinder, said piston being spaced from said cylinder a given distance $\alpha$ around the whole periphery of said piston, (c) a bag-like flexible membrane being disposed in said cylinder engaging said piston, said flexible membrane having an uninflated diameter less than or equal to the diameter of said piston, and having a thickness $\beta$, wherein $2\beta$ is less than $\alpha$, and (d) means for supplying fluid under pressure to said flexible membrane to place said membrane in tension so that it always engages the interior walls of said cylinder and so that it has a convolution in the area between said piston periphery and the cylinder interior walls, a double thickness of said membrane being disposed in said area, and said fluid supplying means being capable of supplying enough fluid under pressure to cause relative movement of said piston with respect to said cylinder.

27. A device as recited in claim 26 wherein said cylinder is formed of concentric tubular members and said piston is annular and said flexible membrane is toroidal.

28. A method of soft earth penetration utilizing a penetrating device having a sharpened tip portion and a conical compacting portion including a plurality of inflatable radially expandable cells mounted on a rigid conical member of said compacting portion, said cells being arranged in increasing diameter from said tip means away therefrom, said method comprising the steps of (a) making a relatively small diameter bore in the earth by supplying a lateral thrust to said penetrating tip to move said tip relative to said compacting means, (b) supplying a lateral thrust to said compacting means, with said cells deflated, to move it into engagement with said penetrating tip while allowing said tip to be retracted, (c) radially expanding said cells to cause compaction of the earth thereabouts a sufficient amount so that a void is formed by each cell of great enough diameter so that the next largest cell may be laterally moved thereinto in its deflated position, (d) deflating all said cells after earth compaction thereby, and (e) repeating steps (a)–(d) until a bore of sufficient length is created.

29. A method as recited in claim 28 wherein means for providing lateral thrust to said compacting means are provided including a mandrel of fixed lateral dimension having disposed thereon laterally expandable force cells with constant radial dimension, and radially expandable force cells with constant lateral dimension, said radial and lateral cells alternating and a lead and a rear lateral cell and a lead and a rear radial cell being provided, and wherein said step (b) of said method is accomplished by sequentially (f) expanding the rear radial cell and the lead lateral cell, (g) expanding the lead radial cell, (h) contracting the rear radial cell, (i) expanding the rear lateral cell and contracting the lead lateral cell, (j) expanding the rear radial cell, (k) contracting the lead radial cell, and (l) expanding the lead radial cell while contracting the rear lateral cell.

30. A method of supplying a lateral thrust to a tubular mandrel to move it forward, the mandrel being of fixed lateral dimension and having disposed thereon two torodial laterally expandable force cells with constant radial dimension, and two toroidal radially expandable force cells with constant lateral dimension, said radial and lateral cells alternating and a lead lateral cell and lead radial cell being provided, said method comprising the steps of sequentially (a) expanding the rear radial cell and the lead lateral cell, (b) expanding the lead radial cell, (c) contracting the rear radial cell, (d) expanding the rear lateral cell and contracting the lead lateral cell, (e) expanding the rear radial cell,
(f) contracting the lead radial cell, and
(g) expanding the lead radial cell while contracting the rear lateral cell.

31. A method as recited in claim 30 wherein the mandrel is moved by steps (a)-(g) a distance corresponding to the difference in length between a lateral cell in the expanded and contracted positions thereof, and wherein the method comprises the further steps of repeating steps (a)-(g) to continuously move the mandrel until a desired position is reached.

32. An assembly for providing lateral thrusts in an area having a confined radial dimension, said assembly comprising (a) a generally cylindrical mandrel of a fixed lateral length,
(b) a pair of lateral force cells mounted on said mandrel and each being expandable and retractable in said lateral direction, the combined length in the lateral direction of said lateral force cells being a fixed amount less than the length of said mandrel, each of said lateral force cells having a substantially constant radial dimension,
(c) a pair of radial force cells mounted on said mandrel each having a substantially fixed lateral dimension but being expandable in the radial direction,
(d) said radial and lateral force cells being alternately disposed on said mandrel,
(e) means for selectively expanding or contracting said force cells for movement of said assembly in the lateral direction, and
(f) constant volume fluid supplying means for supplying a constant volume of fluid to each of said radial force cells upon actuation by said means for supplying fluid under pressure, said means for supplying a constant volume of fluid to each of said radial force cells including a piston movable in a cylinder, and a flexible membrane disposed around said piston and engaging the interior walls of said cylinder, said cylinder being disposed adjacent one of a pair of side plates defining the lateral extent of said radial cell and an aperture being defined in said side plate, and said piston having a sealing means formed thereon so that in the expanded position of said flexible member said piston sealing means closes off said aperture and prevents further delivery of fluid from said cylinder to said radial force cell.

33. A ground penetrating device for forming a borehole, from a ground surface, having radial and lateral dimensions and continuously penetrating the ground by elongation of the borehole, said device comprising (a) a tip portion for penetrating the ground to form the borehole,
(b) means for applying lateral thrust to said tip portion for providing a penetrating force thereto, said lateral thrust applying means comprising
  (i) a generally tubular mandrel of a fixed length,
  (ii) a pair of generally toroidal lateral force cells mounted on said mandrel and each being expandable and retractable in said lateral direction, the combined length in the lateral direction of said lateral force cells being a fixed amount less than the length of said mandrel, and each of said lateral force cells having a substantially fixed radial dimension,
  (iii) a pair of generally torodial radial force cells mounted on said mandrel and having a substantially fixed lateral dimension but being expandable in the radial direction from a first position wherein the walls of the borehole are not engaged thereby, to a second position wherein the walls of the borehole are securely engaged thereby and said cell is effectively anchored to the borehole walls at the area of engagement with said walls,
  (iv) said radial and lateral force cells being alternately disposed along said mandrel, and
  (v) means for selectively applying fluid under pressure to said force cells to provide alternate expansion and contraction thereof for movement of said entire lateral thrust applying means in the lateral direction for applying a lateral thrust,
(c) means leading from said thrust applying means to the surface of ground penetrated by said device, and
(d) a lateral thrust applying means power package and control means disposed on the side of said thrust applying means opposite said tip portion, said power package comprising means for utilizing the flow of drilling fluid through said drill string for powering said thrust applying means.

* * * * *